US006354893B1

(12) United States Patent
Sato

(10) Patent No.: US 6,354,893 B1
(45) Date of Patent: Mar. 12, 2002

(54) MOUNTING STRUCTURE FOR AN OUTBOARD MOTOR

(75) Inventor: Takuya Sato, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/657,051

(22) Filed: Sep. 7, 2000

(30) Foreign Application Priority Data

Sep. 8, 1999 (JP) ..... 11-254646

(51) Int. Cl.[7] ..... B63H 21/30
(52) U.S. Cl. ..... 440/52; 248/640
(58) Field of Search ..... 440/75, 52; 248/640, 248/643

(56) References Cited

U.S. PATENT DOCUMENTS 3,062,173 A * 11/1962 Kiekhaefer
4,303,401 A * 12/1981 Sanmi et al. ..... 440/88
5,180,319 A * 1/1993 Shiomi et al. ..... 440/52
5,443,044 A * 8/1995 VanRens ..... 123/195 HC

FOREIGN PATENT DOCUMENTS

JP 7-324659 12/1995
JP 10-119891 5/1998

* cited by examiner

*Primary Examiner*—Sherman Basinger
(74) *Attorney, Agent, or Firm*—Finnegan, Henderson, Farabow, Garrett & Dunner, L.L.P.

(57) ABSTRACT

In an outboard motor equipped with an engine 3 mounted on an engine holder 2 that is attached to a hull by a mounting device 6, and equipped with a crankshaft 4 disposed more or less vertically within the engine 3 and from which rotational force is transmitted to a propelling device by a drive shaft 10, the axis of the drive shaft 10 is disposed at a position offset away from the axis of the crankshaft 4 a little to the rear of the outboard motor 1, a pair of left and right mount holders 58 are formed adjacent to the center of gravity CG of the outboard motor 1 within the engine holder 2, the mount units 21 are inserted into these mount holders 58 from the front side of the engine holder 2, the drive shaft 10 is inserted between the mount holders 58, and the mount holders 58 are formed as close as possible to a protective wall 60 for the drive shaft 10 so that the mount holders 58 can clear the protective wall.

4 Claims, 9 Drawing Sheets

MOUNTING STRUCTURE FOR AN OUTBOARD MOTOR

CROSS REFERENCE TO RELATED APPLICATION

This application is related to and claims priority of Japanese Patent Application No. 254646, filed in Japan on Sep. 8, 1999, which is expressly incorporated herein by reference in its entirety.

BACKGROUND OF THE INVENTION

I. Field of the Invention

The present invention relates to a mounting structure for an outboard motor.

II. Description of the Related Art

In general, an outboard motor is mounted to the hull of a boat via a clamp bracket. Also, an outboard motor is, for example, attached to a clamp bracket at upper and lower points of the motor via two mounting devices (the upper one constituting a steering bracket).

The mounting devices are equipped with a left-right pair of mount units and arranged widthwise on the outboard motor. A mount gum portion, which may be made of an elastic material such as rubber, is provided in the mount units to reduce vibration transmitted to the hull of the boat from the engine.

Generally, among the mount units, the upper mount unit is, for example, attached to an engine holder, while the lower mount unit is attached to a drive shaft housing. The manner of mounting the mount unit (e.g., the upper mount unit) to the engine holder generally involves mounting a portion of the mount gum portion of the upper mount unit into a mount holder previously formed on the engine holder during the casting stage, and then, pressing the mount gum portion via the mount cover to secure the mount sum portion. Also, there are two ways in which the mount gum portion can be inserted into the engine holder. Namely, a method of insertion from the top side of the engine holder, and a method of insertion from the front of the engine holder.

It is desirable for the mount gum portion of the upper mount unit to be adjacent to the center of gravity of the entire outboard motor so as to absorb vibration from the engine sufficiently and also it is desirable that the right and left pitch is sufficiently narrow.

However, in the method whereby the mount gum portion of the upper arm unit is inserted into the mount holder formed on the engine holder from the front side of the engine holder, because a drive shaft is inserted between the right and left mount gum portions, it is difficult to make the right-left pitch of the mount gum portions narrow because the protective wall for the drive shaft becomes blocked.

Moreover, when a mount gum portion is to be located adjacent to the center of gravity of the entire of the outboard motor, the front-back direction of the cylindrical mount holder becomes long, machining becomes difficult, and sufficient capacity for the mount holder is not obtained owing to issues related to the draft when casting. As a result, the mount has become small-sized in some cases. Also, when the front-back direction of the mount holder becomes long, the configuration of the mount cover, which presses on the mount gum portion, will end up with a complex shape.

Furthermore, when the mount gum portion of the upper mount unit is inserted into the cylindrical mount holder from the front side of the engine holder, the mount holder becomes sealed airtight and there is no place for internal air to escape. As a result, it is extremely difficult to insert the mount gum portion, and when the mount gum portion is removed from the mount holder for maintenance, etc., negative pressure is then generated within the mount holder, and it becomes extremely difficult to remove the mount gum portion.

Conventionally, to solve the problems described above, some mount gum portions are formed with grooves on their outer peripheral surface. However, when a groove is formed in the mount gum portion itself, the spring constant changes and the vibration absorption property may be adversely affected. Also, because grooves may generate directivity in the mount gum, there are cases where assembly requires careful attention.

Also, when the upper mount unit is installed on the steering bracket, the mount bolt for the upper mount unit is inserted through a mount arm formed on the steering bracket and is fastened at the end of the mount bolt with a nut, the mount bolt is pressed with a hand or another implement, or a whirl-stop notch is provided in the mount bolt to prevent turning. However, this technique involves a number of problems, such as insufficient tightening torque, and a decrease in the strength of the mount bolt owing to the notch, etc.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

The present invention was made with the exemplary object of overcoming the above described disadvantages of the prior art by providing a mounting structure of an outboard motor for reducing vibration.

Another exemplary object of the present invention is to provide a mounting structure of an outboard motor that reduces the number of assembling processes and improves workability or the process of manufacturing such a mounting structure.

In order to solve the exemplary problems described above, the mounting structure for an outboard motor of the present invention is, as described herein, such that in an outboard motor equipped with an engine mounted on an engine holder and installed onto the hull of a boat via a mounting device, and equipped with a crankshaft disposed more or less vertically within the engine, rotational force of this crankshaft is transmitted to a propelling device via a drive shaft, the axis of the drive shaft is located at a position offset away from the axis of the crankshaft a little to the rear of the outboard motor, and a pair of right and left mount holders is formed adjacent to the center of gravity of the outboard motor within the engine holder. The mount units are inserted into these mount holders from the front side of the engine holder, the drive shaft is inserted between the mount holders, and the mount holders are formed at the closest possible position to clear the protective wall for the drive shaft.

Also, to resolve the exemplary problems described above, the mount units are inserted into the mount holders from the front side of the engine holder and secured on the engine holder by mount covers from the front side so as to be freely attached or removed, and the mount covers are formed into a right-left asymmetrical configuration so as to clear the protective wall of the drive shaft.

Further, to resolve the problems described above, an exemplary aspect of the present invention includes openings on the front side of the engine holder of the mount holders disposed a little behind the drive shaft.

Moreover, to solve the problems described above, the mount unit comprises a mount bolt, a stopper formed somewhere along the mount bolt, a hollow inner tube disposed around a portion of the mount bolt behind the stopper, the rubber gum portion winding around the periphery of this inner tube, and a back nut for fixing the inner tube and the mount gum disposed and at the rear end of the mount bolt. In addition, the mount unit is divided into a rear mounting portion and a front steering fixing portion bordering with the stopper, the mounting portion is formed by fixing the mount gum portion to the mount bolt prior to the stage at which the mounting device is attached and this mounting portion is fixed to the engine holder, whereupon the steering fixing portion is fixed to a bracket that is provided on the hull of a boat.

Furthermore, to solve the problems described above, the stopper, which is located somewhere along the mount bolt, is formed into a non-circular configuration, and a fit corresponding to the sectional configuration of the stopper is formed in the bracket provided on the side of a hull, the stopper of the mount bolt engages this fit and thereby stops the mount bolt from turning.

Still further, to resolve the problems described above, a reverse thrust rubber is mounted onto the back nut and a receiver is formed at the back of the mount holder to receive the reverse thrust rubber therein.

Also, to resolve the problems described above, a groove is formed at the bottom on the inner peripheral surface of the mount holder that extends in the front-rear direction up to the opening of the mount holder on the front face of the engine holder.

It is to be understood that both the foregoing general description and the following detailed description are only exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION

Reference will now be made in detail to the present preferred embodiments of the invention illustrated in the accompanying drawings. Wherever possible, the same reference numbers are used throughout the drawings to refer to the same or like parts. Hereinafter, an embodiment of the present invention will be explained based on figures.

Figure 1:
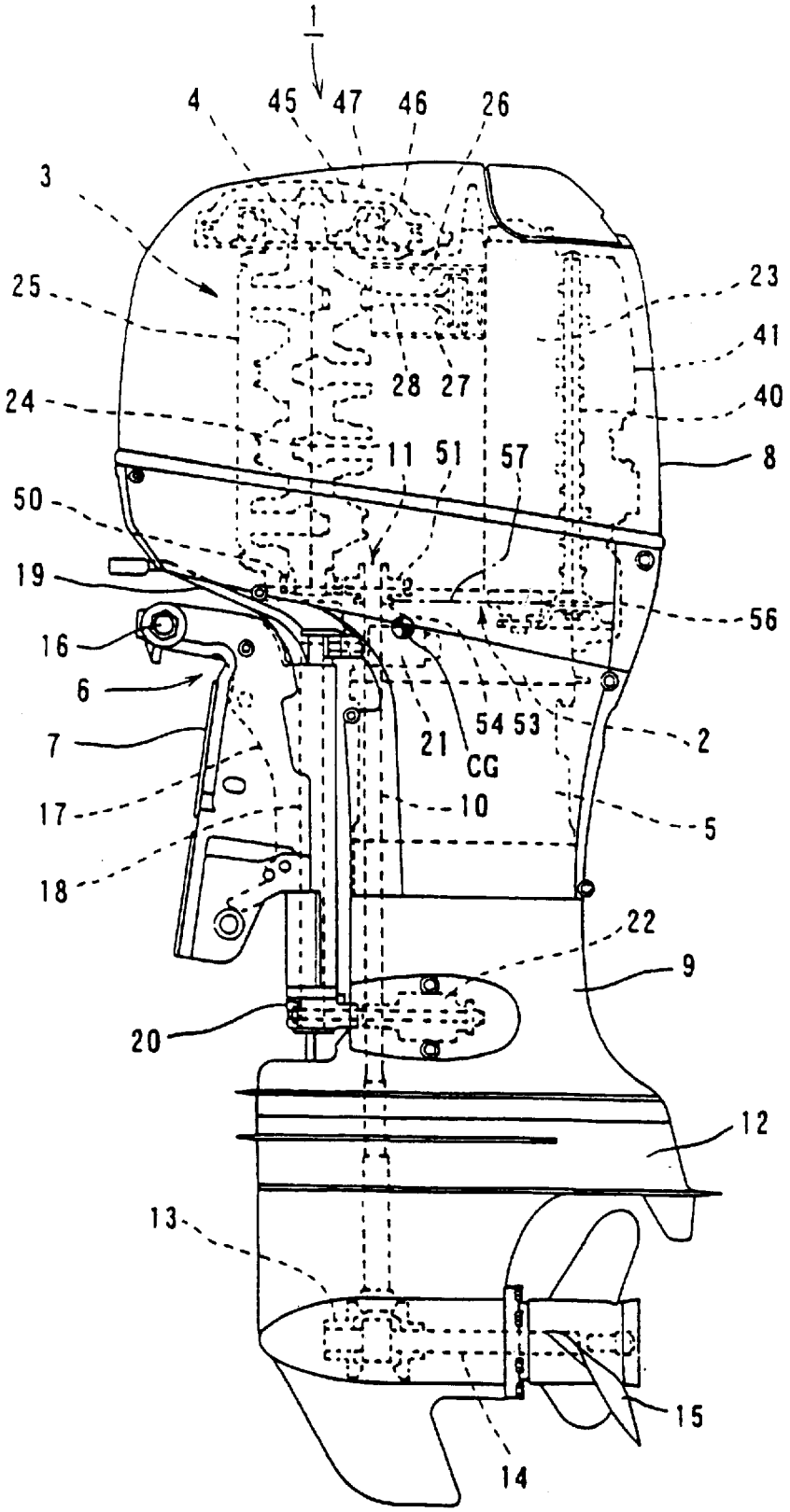
FIG. 1 is a left side view of an outboard motor depicting one embodiment of the mounting structure for an outboard motor of the present invention.

FIG. 1 depicts a left side elevated view of an embodiment of an outboard motor wherein this invention is appropriated. As shown in FIG. 1, an outboard motor 1 is provided with an engine holder 2, and an engine 3 is situated on an upper portion of this engine holder 2. Moreover, this engine 3 is a vertical type engine in which a crankshaft 4 is located in a more or less vertical direction.

Located under the engine holder 2 is an oil pan 5 and, for example, a clamp bracket 7 is attached to the outboard motor 1 via a mounting device 6, and the outboard motor 1 is mounted on a transom (not shown) of the hull of a boat by means of the clamp bracket 7. The engine 3, the engine holder 2 and the oil pan 5 of the outboard motor 1 are surrounded and covered by an engine cover 8.

Situated in a lower portion of the oil pan 5 is a drive shaft housing 9. Disposed more or less vertically inside the engine holder 2, the oil pan 5 and the drive shaft housing 9 is a drive shaft 10, and its upper end is connected to the lower end of the crankshaft 4 via a coupling means 11. The drive shaft 10 is structured such that it extends downward within the drive shaft housing 9 to drive a propeller 15, which is a propelling device, via a bevel gear 13 in a gear case 12 provided in the lower portion of the drive shaft housing 9, as well as via the propeller shaft 14.

A swivel bracket 17 is provided in the clamp bracket 7 via a tilt shaft 16 and a pilot shaft 18 in a perpendicular direction within this swivel bracket 17 and is supported such that it rotates freely. Furthermore, in both the upper end and the lower end of this pilot shaft 18 are provided an upper mount bracket 19 and a lower mount bracket 20 that serve, respectively, as steering brackets for obtaining integral rotation.

Provided in a front portion of the engine holder 2 is a pair of upper mount units 21 provided linearly right and left widthwise with respect to the outboard motor 1 and are coupled with the upper mount bracket 19. Also, provided on both sides of the drive shaft housing 9 is a pair of the lower mount units 22 that are connected with the lower mount brackets 20. With the mounting device 6 structured as described above, the outboard motor 1 can be controlled rightward and leftward around the pilot shaft 18 relative to the clamp bracket 7 and allows the outboard motor 1 to be tilted up around the tilt shaft 16.

Figure 2:
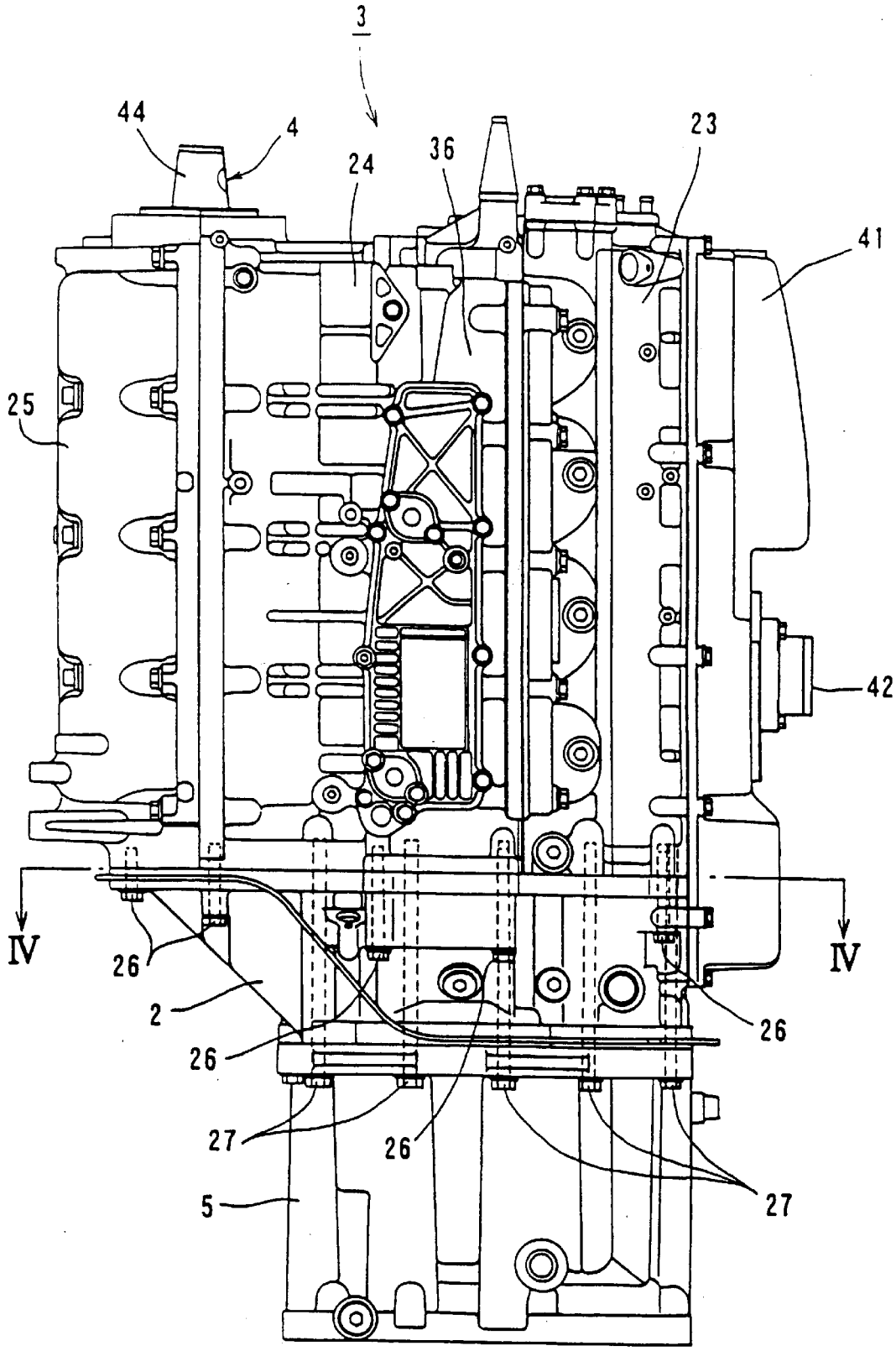
FIG. 2 is an enlarged left side view of a central portion of an outboard motor.
Figure 3:
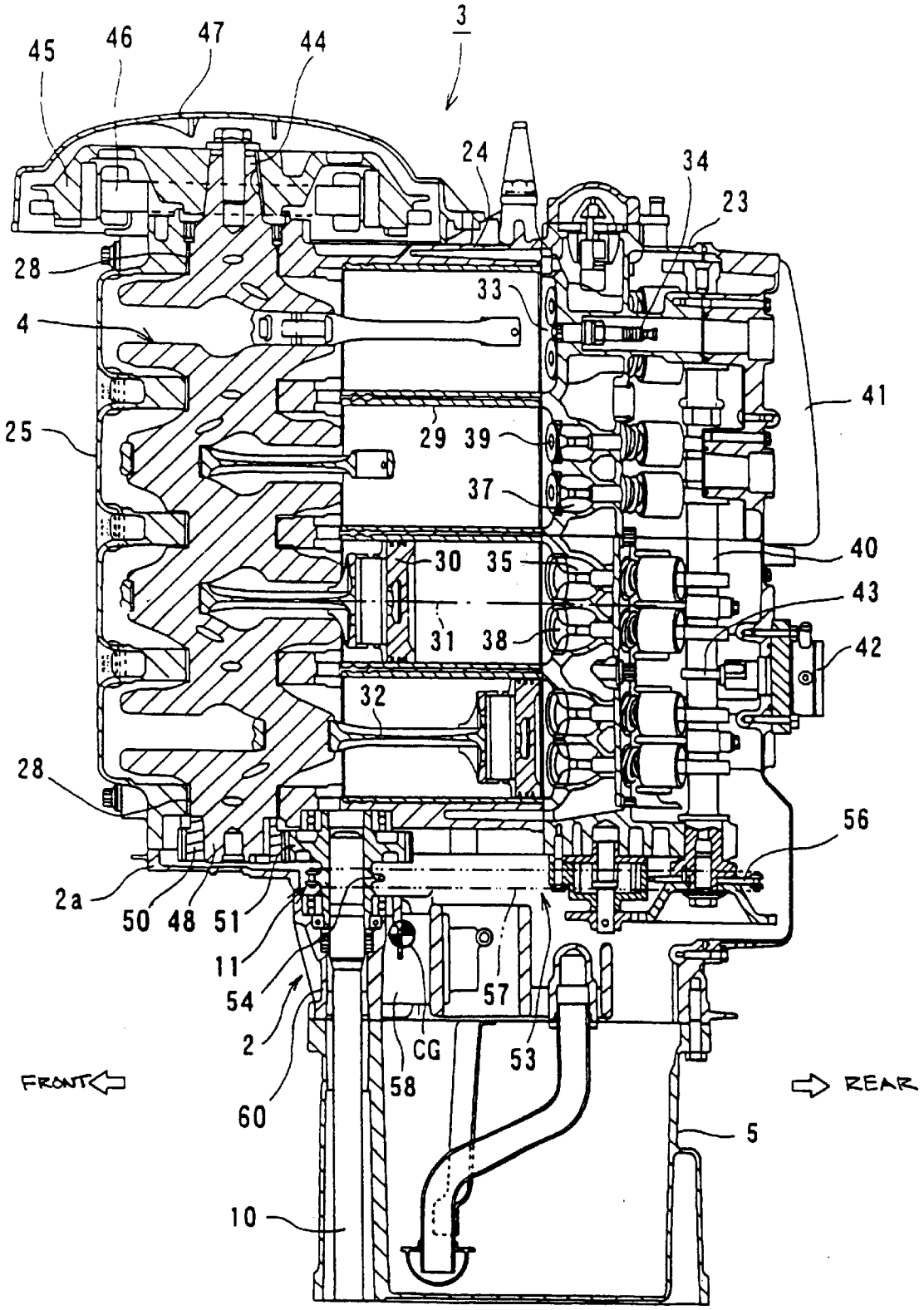
FIG. 3 is a longitudinal sectional view of FIG. 2.

FIG. 2 depicts an enlarged left side elevation view of the central part. FIG. 3 is a longitudinal sectional view of FIG. 2. As shown in FIGS. 2 and 3, the engine 3 mounted on the outboard motor 1 is, for example, a water-cooled, four-stroke, in-line four-cylinder engine comprising, for example, an assembled cylinder head 23, a cylinder block 24, and a crankcase 25, etc.

At the extreme front of the engine 3, the cylinder block 24 is located behind (starboard stern side) the crankcase 25 installed at the extreme left side (port bow side) as illustrated in FIGS. 2 and 3. Disposed behind the cylinder block 24 is a cylinder head 23. As depicted in FIG. 2, the lower surfaces of the cylinder head, 23, cylinder block 24, and the crankcase 25 are, for example, formed on the same plane and mounted on the upper face of the engine holder 2, and the cylinder head 23, the cylinder block 24 and the crankcase 25 are all fixed by being tightened to the engine holder 2 by multiple bolts 26 from the lower surface of the engine holder 2.

Furthermore, multiple bolts 27 penetrate through the engine holder 2 from the bottom of the oil pan 5 located under the engine holder 2 and extend, for example, to the lower portion of the cylinder head 23 and the cylinder block 24. The engine holder 2 and the oil pan 5 are fastened together, and fixed to, both the cylinder head 23 and the cylinder block 24.

As depicted in FIGS. 1 and 3, the crankshaft 4 is, as described above, supported more or less vertically via, for example, multiple metal bearings 28 within the joining surfaces of the crankcase 25 and the cylinder block 24. Within the cylinder block 24, four cylinders 29 are formed more or less vertically in a row, and a piston 30 is inserted into the cylinder 29 such that it slides freely along the direction of the axis 31.

Furthermore, the crankshaft 4 and the piston 30 are connected by a connection rod 32 whereby the reciprocating stroke movement of the piston 30 is converted into the rotational motion of the crankshaft 4.

Formed within the cylinder head 23 is combustion chamber 33 that matches the cylinder 29, and a spark plug 34 is connected thereto from the outside. Formed in the cylinder head 23 are intake port 35 that communicates with the combustion chamber 33, and formed at the left side of the cylinder block 24 and the engine holder 2 is an exhaust port 37 that communicates with the exhaust path 36. Further, located in the cylinder head 23 are intake valves 38 and exhaust valves 39 that open and close both ports 35 and 37. Still further, located parallel with the crankshaft 4 and behind the cylinder head 23 are two cam shafts 40 that function to open and close the intake valves 38 and the exhaust valves 39.

The cylinder head 23 is covered over by a cylinder head cover 41. The cylinder head cover 41 is provided with a mechanical fuel pump 42, and this mechanical fuel pump 42 is driven by a cam 43 provided on the cam shaft 40.

As depicted in FIG. 3, the upper end of the crankshaft 4 projects up beyond the engine 3. This projection 44 is provided with a flywheel 45 and a magnet device 46 for power generation, and all of these are covered over by a magnet cover 47.

Also, the axes off the crankshaft 4 and the drive shaft 10 are located in an offset position, respectively. For example, the axis of the drive shaft 10 is located at a position behind and away from the axis of the crankshaft 4 (toward the cylinder head 23).

By offsetting the drive shaft 10 a little backward, the front portion of the engine holder 2 and the oil pan 5 can move a little backward (or, the front portion of the engine 3 disposed above the engine holder 2 can move a little forward). As a result, the position of the center of gravity CG of the entire outboard motor 1 shifts toward the front side while, at the same time, a space is formed directly under the crankshaft 4, and the mounting device 6 is positioned so that the pilot shaft 18 can be positioned on more or less the same axis line as crankshaft 4. The bottom of the crankcase 25 directly above this space is covered from below by an extended portion 2*a* that is formed by extending the upper front portion of the engine holder 2 forward.

The lower end of the crankshaft 4 protrudes towards the bottom of the engine 3, and a crank gear 50 is forcedly inserted into this projection 48. In addition, the connection means 11 is, for example, spline-engaged with the upper end of the drive shaft 10 and coaxially therewith, the drive shaft 10 protruding over the engine holder 2. As a driven gear 51 formed integrally with the connection means 11 that engages with the crank gear 50, when the crankshaft 4 spins, its rotational force is transmitted from the crank gear 50, to the driven gear 51, and the drive shaft 10 is driven to spin.

Provided in a space between the lower portion of the engine 3 and the upper surface of the engine holder 2 is a cam shaft drive mechanism 53 that transmits the spin of the crankshaft 4 to the cam shaft 40, thereby causing the cam shaft 40 to spin. This cam shaft drive mechanism 53 has, for example, a chain driven format comprising a timing sprocket 54 formed integrally with the connection means 11 below the driven gear 51 formed integrally with the connection means 11, a pair of the cam sprockets 56 (right and left; one for intake and one for exhaust) provided at the lower end of two cam shafts 40 that protrude toward lower surface of the engine 3 and turn integrally, and a timing chain 57 winding around the sprockets 54 and 56.

Figure 4:
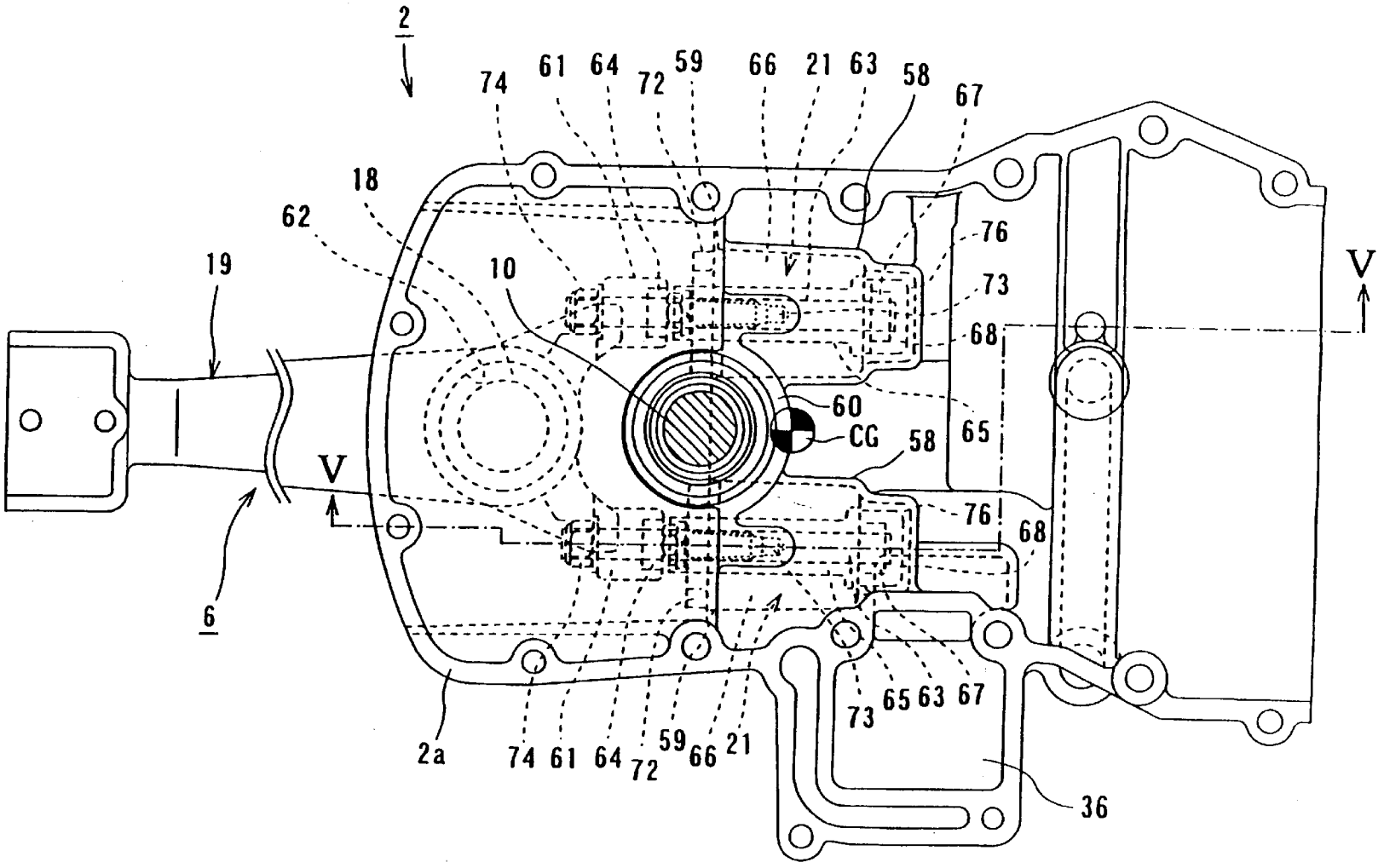
FIG. 4 is a sectional view cut along arrows IV—IV in FIG. 2.
Figure 5:
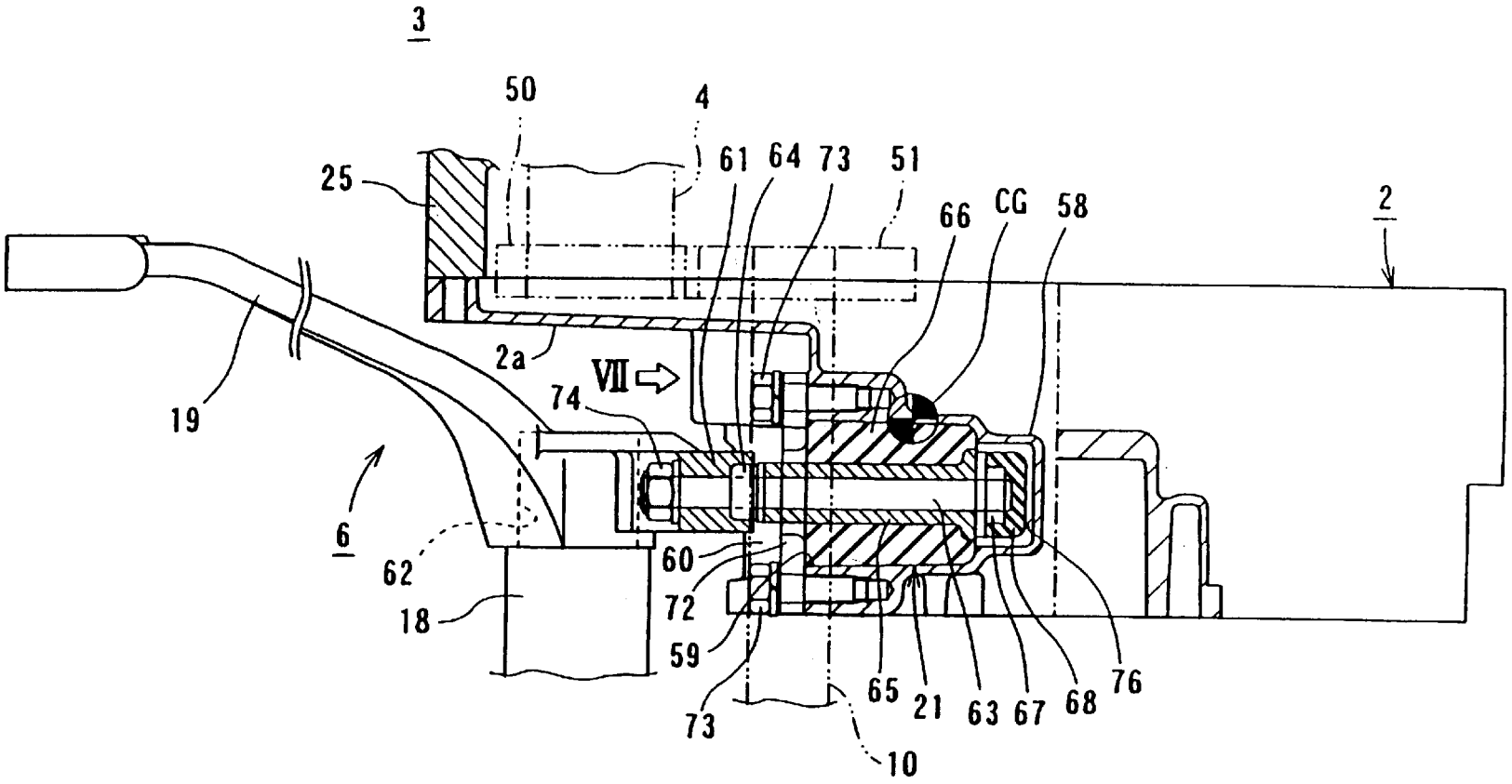
FIG. 5 is a sectional view cut along arrows V—V in FIG. 4.

FIG. 4 is a sectional view along lines IV—IV in FIG. 2 and depicts in detail the coupling structure between the upper mount unit 21 and the upper mount (steering) bracket 19. FIG. 5 is a sectional view along lines V—V in FIG. 4.

As depicted in FIGS. 4 and 5, formed in the front portion of the engine holder 2 is a left and right pair of cylindrical mount holders 58 that extend in the front-back direction, at the left side in the figure, adjacent to the center of the gravity CG (vertical direction in FIG. 4) of the outboard motor 1. The openings 59 of the front part are made in the front face of the engine holder 2. Furthermore, the drive shaft 10 is inserted between the right and left mount holders 58, and protective wall 60 of the drive shaft 10 is formed between a mount holder 58 and the drive shaft 10. The mount holders 58 are formed at the closest possible position to the protective wall 60 to clear the wall 60.

In the rear part of the upper mount (steering) bracket 19 is a right and left pair of mount arms 61 extending toward the rear (right side in the figure), and the pilot shaft 18 discussed earlier is inserted through a shaft hole 62 formed between these mount arms 61 and fixed.

Figure 6:
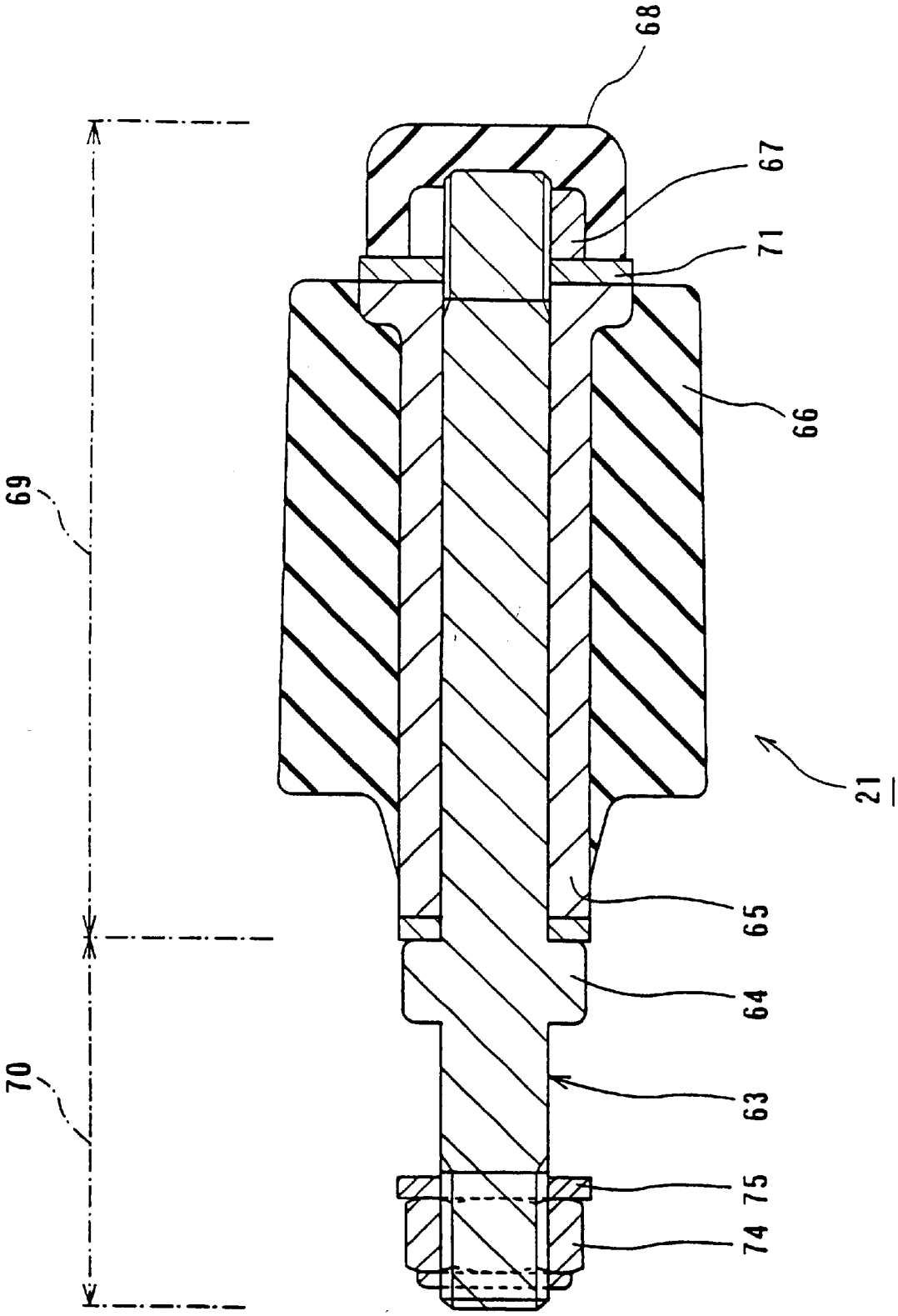
FIG. 6 is an enlarged sectional view of the upper mount unit.

FIG. 6 is an enlarged sectional view of the upper mount unit 21 described above. As depicted in FIG. 6, the upper mount unit 21 essentially comprises a rod-shaped mount bolt 63, a stopper 64 formed somewhere along the mount bolt 63, a cylindrical inner tube 65 disposed around the mount bolt 63 behind the stopper 64, a mount gum 66 made of an elastic material, such as rubber, that winds around this inner tube 65 with the back ends, thereof on the same plane, a back nut 67 for positioning the inner tube 65 and the mount gum 66 between the stopper 64, and a reverse thrust rubber 68, etc., into which this back nut 67 is mounted.

The upper mount unit 21 is also divided into a rear mounting portion 69 and a front steering fixing portion 70 bordering with the stopper 64. Mounted between the inner tube 65 and the reverse thrust rubber 68 is a rear mount washer 71. Prior to assembling the upper mount unit 21 to the mounting device 6, the mounting portion 69 is preformed by fixing the mount gum 66 to the mount bolt 63 and is subsequently inserted into the mount holder 58 of the engine holder 2 from the front, and is then supported by the engine holder 2 by fixing the mount cover 72 from the front to the engine holder 2 by bolts 73 so as to be easily attached or removed.

After the mounting portion 69 is fixed to the engine holder 2, the steering fixing portion 70, that is, the front half of the mount bolt 63, is inserted through a mount arm 61 formed at the back portion of the upper mount (steering) bracket 19, and the upper mount unit 21 is fixed by the front nuts 74 from the front. Mounted between the front nuts 74 and the mount arm 61 is a front mount washer 75.

Formed in the back of the mount holder 58 is a receiver 76 for the reverse thrust rubber 68. When the mount gum 66 of the upper mount unit 21 is inserted into the mount holder 58, the reverse thrust rubber 68 on the rear end portion of the upper mount unit 21 is received into this receiver 76.

Figure 7:
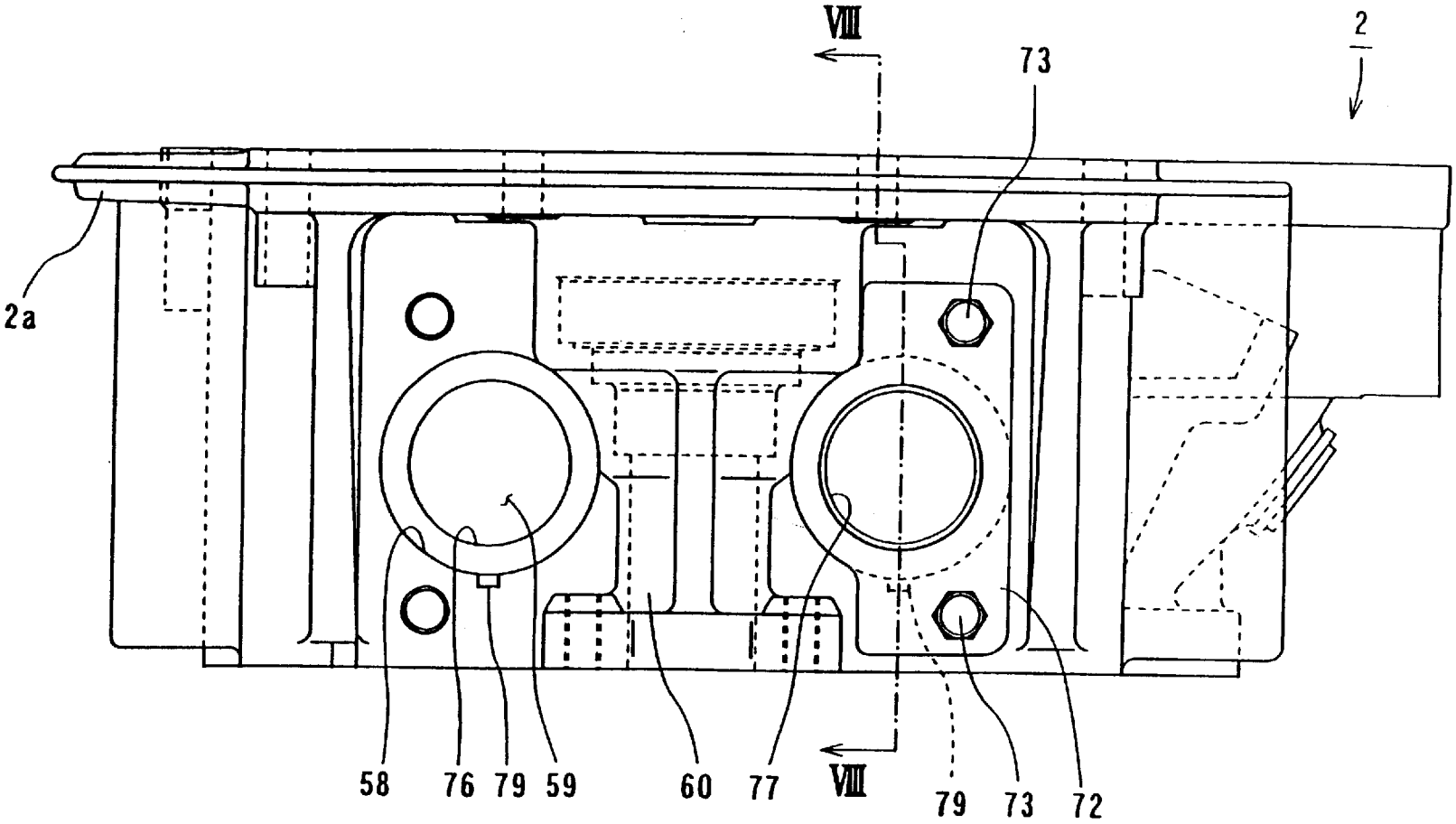
FIG. 7 is a view as seen from arrow VII in FIG. 5.
Figure 8:
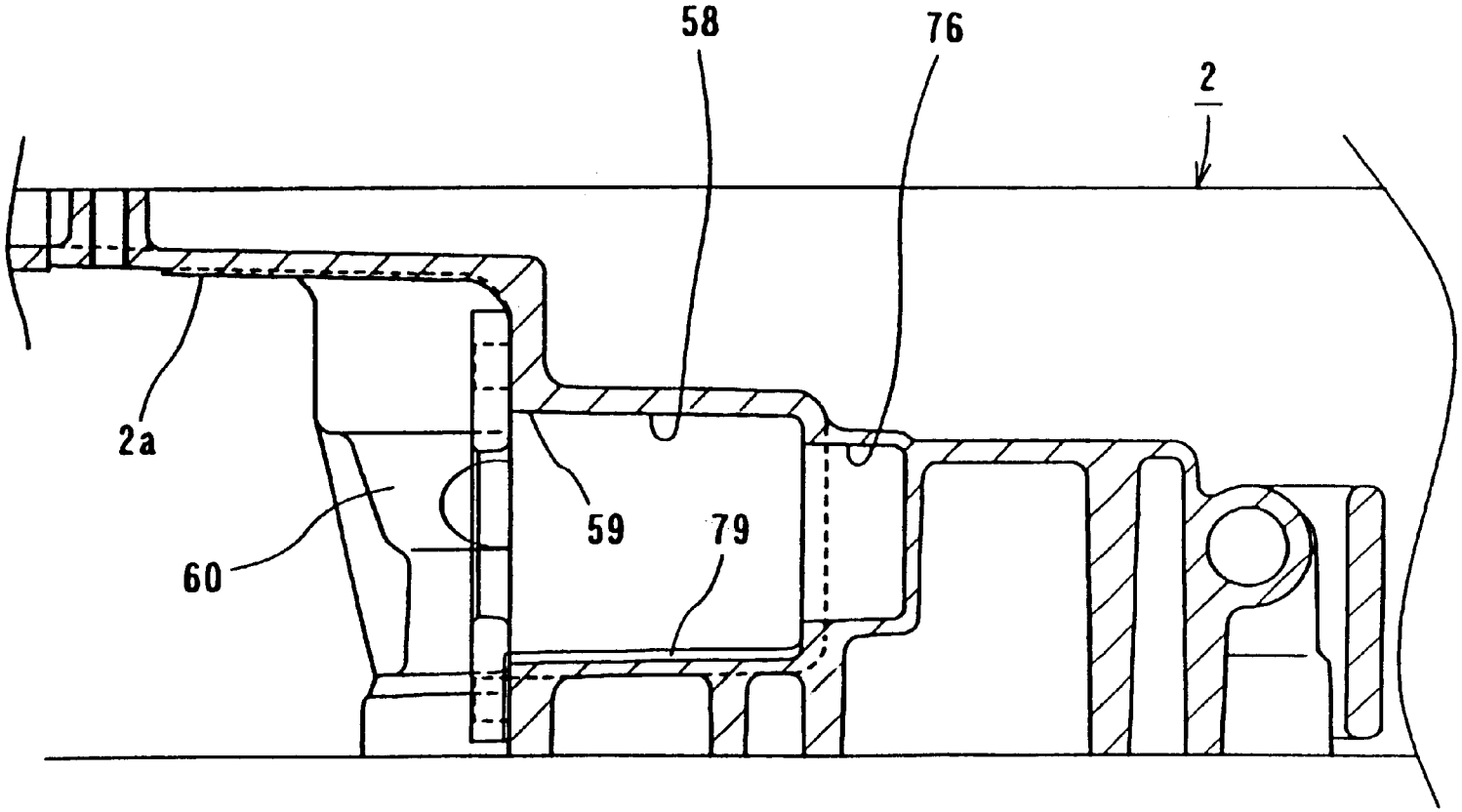
FIG. 8 is a sectional view cut along lines VIII—VIII in FIG. 7.

FIG. 7 is a view seen from the direction of arrow VII in FIG. 5 and depicts the front face of the engine holder 2. The right side from the protective wall 60 for the drive shaft 10 depicts a state in which the mount cover 72 is mounted, while the left side of the mount cover 72 depicts a state in which the mount cover 72 is not mounted. FIG. 8 is a sectional view along lines VIII—VIII in FIG. 7.

As depicted in FIGS. 4, 5, 7 and 8, the mount cover is, for example, plate-shaped and has an opening 77 smaller than the diameter of the mount gum 66 but larger than the diameter of the stopper 64 on the mount bolt 63 and formed into a right and left asymmetrical configuration that clears the protective wall 60 of the drive shaft 10 and is fixed to the upper portion and the lower portion of the engine holder 2 by bolts 73 so as to be freely attached or removed.

Formed at the bottom on the inner peripheral surface of the mount holder 58 is a groove 79 extending in a front-back direction up to the opening 59 of the mount holder 58 on the front face of the engine holder 2. This groove 79 serves as an air vent to prevent an airtight status from occurring inside the mount holder 58 when inserting the upper mount unit 21 into the mount holder 58, or when removing the upper mount unit 21 from the mount holder 58.

Figure 9:
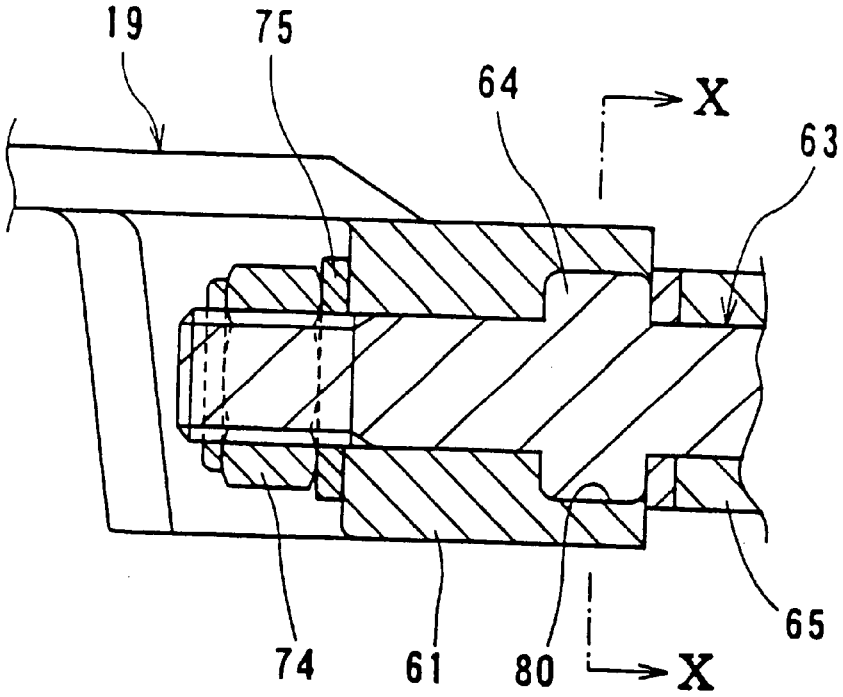
FIG. 9 is an enlarged view of the mount arm part of the upper mount (steering) bracket 19.
Figure 10:
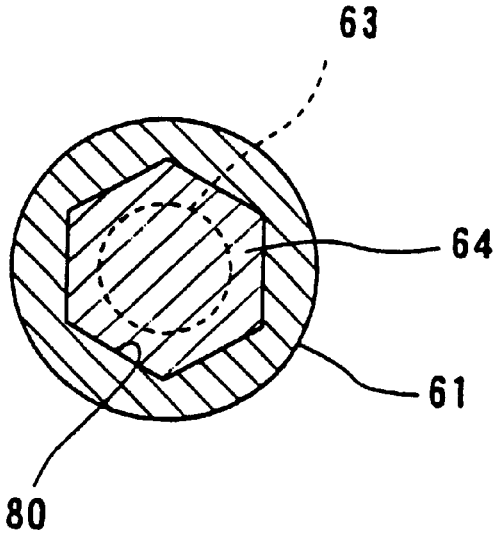
FIG. 10 is a sectional view cut along lines X—X in FIG. 9.

FIG. 9 is a diagram of an enlargement of the mount arm 61 of the upper mount (steering) bracket 19. FIG. 10 is a sectional view along lines X—X in FIG. 9.

As shown in FIGS. 9 and 10, the stopper 64 formed somewhere along the mount bolt 63 has a non-circular sectional configuration (i.e., a configuration that is not circular). The present embodiment has a hexagonal-sectional configuration, while a fit 80 that corresponds to the sectional configuration of this stopper 64 is formed on the mount arm 61. By engaging the stopper 64 on the mount bolt 63 into this fit 80, the movement of the mount bolt 63 is controlled in the circumferal direction. When tightening the front nut 74 at the front end of the mount bolt 63, the mount bolt 63 is prevented from spinning.

Reference will now be made in detail to how the illustrated embodiments of the present invention operate.

Since the axes of the crankshaft 4 and the drive shaft 10 are disposed at an offset position, that is slightly back from the axis of the crankshaft 4 (toward the cylinder head 23), a space is generated directly below the crankshaft 4 in front of the engine holder 2 and the oil pan 5 that enables the disposal therein of a mounting device 6 comprising a swivel bracket 17, a mount bracket, a pilot shaft 18, etc. As a result, the overall front-back length of the outboard motor 1 can be reduced, resulting in a compact outboard motor 1.

Also, by reducing the overall front-back length of the outboard motor 1, a left-right pair of upper mount units 21 provided in front of the engine holder 2 can then be positioned adjacent to the center of the gravity CG of the outboard motor 1, whereby the vibrations transmitted from the engine 3 to the hull of a boat can be greatly reduced.

Further, by allowing the upper mount unit 21 to be positioned adjacent to the center of the gravity CG of the outboard motor 1, openings 59 of the mount holder 58 on the front face of the engine holder 2 can be made at a location slightly back from the drive shaft 10 (toward the cylinder head 23). As a result, when the mount gum 66 of the upper mount unit 21 is mounted on the mount holder 58, the front end of the mount gum 66 is positioned on the same plane as, or adjacent to, the openings 59, resulting in a simple mount cover 72 configuration that was conventionally complex and, moreover, cost and weight reduction can be devised.

In addition, because the front-back length of the mount holder 58 can be reduced, improved weigth reduction, casting properties, and machine properties, as well as reduced machining parameters, can be devised. Also, a sufficient mount holder 58 capacity can be provided.

Also, by forming the mount holder 58 at the maximum possible position to clear the protective wall 60 of the drive shaft 10, sufficient mount holder 58 capacity can be provided and, by forming the mount cover 72 in an asymmetrical configuration so that it clears the protective wall 60 of the drive shaft 10, the pitch of the left and right mount gums 66 can become narrow, whereby the upper mount unit 21 can be positioned closer to the center of gravity CG of the outboard motor 1.

Further, the upper mount unit 21 is divided into a rear mounting portion 69 and a front steering fixing portion 70 bordering with the stopper 64. At a stage prior to the assembly of the mount device 6, its mount gum portion 66 is fixed in advance to the mount bolt 63, thereby forming the mount portion 69. If, after this mount portion 69 has been fixed to the engine holder 2, the steering fixing portion 70 is fixed to the upper mount (steering) bracket 19, the number of assembly processes will decline and productivity will improve.

Still further, by forming, at the bottom on the inner peripheral surface of the mount holder 58, a groove 79 that extends in the front-back direction up to the opening 59 of the mount holders 58 on the front face of the engine holder 2, it becomes easy to insert or remove the upper mount unit 21. Moreover, it becomes easy to drain water even when, for example, water penetrates inside the mount holder 58 during navigation, resulting in improved durability of the upper mount unit 21.

Furthermore, by providing a stopper 64 having a non-circular configuration somewhere along the mount bolt 63 and by engaging this stopper 64 in the mount arm 61 to prevent the mount bolt 63 from turning, it becomes unnecessary, for example, to provide a whirl-stop mechanism in the front mount washer 75 or to provide a whirl-stop notch in the mount bolt 63 when tightening and fixing the front end portion of the mount bolt 63 with the front nut 74.

Also, it becomes unnecessary to restrain the mount bolt 63 by hand or with another implement when tightening the front end portion of the mount bolt 63 with the front nut 74. As a result, the structure can be made simpler and assembly work improves. Moreover, sufficient tightening torque is obtained without decreasing the strength of the mount bolt 63.

The displacement of the mounting bracket 6 caused by reverse rotation of the outboard motor 1 engine is conventionally controlled by interpolating a thrust stopper comprising an elastic material such as rubber, etc., between the outboard motor and the clamp bracket. In the present invention, by providing the back end of the inner tube 65 and the back end of the mount gum 66 on the same surface, and by mounting the reverse thrust rubber 68 onto the back nut 67 provided on the rear end of the mount bolt 63, it becomes possible for this reverse thrust rubber 68 to function as a thrust stopper.

Also, when the outboard motor 1 is propelled in reverse, the transom (not shown) of the hull becomes resistant, and the outboard motor becomes displaced by moving in all directions, up and down, right and left. However, by housing the reverse thrust rubber 68 in the receiver 76 formed at the back of the mount holder 58, it becomes possible to receive the thrust from every three-dimensional direction.

In the embodiment described above, the example depicts an application of the present invention to an in-line four-cycle engine 3. However, the present invention is applicable to other types of engine irrespective of the number of cylinders. Further, the present invention can also be applied to V-type engines in which cylinders are disposed in V-form when viewed from above.

According to the mounting structure for an outboard motor of the present invention as described above, a crankshaft in an outboard motor is positioned more or less vertically inside an engine mounted on an engine holder that can be attached to a hull by means of a mount device, and the rotational force of this crankshaft is transmitted to a propelling device by means of a drive shaft. The axis of the drive shaft is positioned such that it is offset from the axis of the crankshaft slightly toward the rear of the outboard motor, and a left and right pair of mount holders are formed adjacent to the center of gravity of the outboard motor within the engine holder, and the mount units are inserted into these mount holders from the front of the engine holder. Moreover, the drive shaft is inserted between the mount holders, and the mount holders are formed and disposed at the closest possible position to clear the protective wall of the drive shaft. Therefore, the mount holder capacity can be sufficient and engine vibrations can be largely reduced.

The mount units are inserted into the mount holders from the front of the engine holder and secured to the engine holder in a freely removable manner from the front and by way of the mount cover, and the mount cover is formed into a left-right asymmetrical configuration so as to clear the protective wall of the drive shaft, and so the left-right pitch of the mount gum can be made narrow, and engine vibrations can be further reduced.

Since openings of the mount holders on the front side of the engine holder are made a little behind the drive shaft, making the engine holder lightweight, improving casting, and improving workability can be devised.

Since the mount unit comprises a mount bolt, a stopper formed somewhere along the mount bolt, a cylindrical inner tube positioned around the mount bolt behind the stopper, a mount gum winding around this inner tube, and a back nut for fixing the inner tube and the mount gum and provided in the back end of the mount bolt. Furthermore, the mount unit is divided into a rear mounting portion and a front steering fixing portion bordering with the stopper, and the mounting portion is assembled by fixing the mount gum to the mount bolt beforehand at the stage the mount device is assembled, and after this mounting portion is fixed to the engine holder, the steering fixing portion is fixed to a bracket provided on the hull of a boat, whereby assembling workability improves.

Since the stopper formed somewhere along the mount bolt is formed into non-circular cross sectional configuration, and a fit that corresponds to the sectional configuration in a bracket that is provided on the side of the hull, and the stopper of the mount bolt engages this fit and prevents the mount bolt from turning, whereby assembly workability improves.

Since a reverse thrust rubber is mounted onto the back nut, and a receiver is formed in the back end of the mount holder to receive the reverse thrust rubber, it becomes possible to receive thrust from every direction caused by the displacement generated by the outboard motor.

Since a groove is formed at the bottom on the inner peripheral surface of the mount holder extending in the front-back direction up to the opening of the mount holder on the front face of the engine holder, assembling or removing workability improves, as does the durability of the mount unit.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

What is claimed is:

1. A mounting structure for an outboard motor, comprising:

a crankshaft disposed roughly vertically in an engine mounted on an engine holder attached to the hull of a boat via a mounting device such that the rotational force of the crankshaft is transmitted to a propelling device via a drive shaft;

a drive shaft for transmitting a rotational force of the crankshaft to a propelling device, the drive shaft being disposed so that its axial center is offset from an axial center of the crankshaft toward a rear side of the outboard motor;

a pair of left and right mount holders formed in the engine holder in the vicinity of the center of gravity CG of the outboard motor; and wherein the drive shaft is inserted between the pair of left and right mount holders while at least one mount unit is inserted from the front of the engine holder into the mount holders, and the mount holders are formed at a maximum position that will also maintain clearance from a protective wall of the drive shaft.

2. The mounting structure for an outboard motor according to claim 1, wherein the mount unit is inserted into the mount holders from the front side of the engine holder and secured by at least one mount cover so as to be easily attached or removed from the front, and the mount cover is formed into a right-left asymmetrical configuration so as to maintain clearance from the protective wall of the drive shaft.

3. The mounting structure for an outboard motor according to claim 1, wherein openings on a front side of the engine holder on the mount holders are located a little behind the drive shaft.

4. The mounting structure for an outboard motor of claim 1, wherein a groove is formed at a bottom of a inner peripheral surface of the mount holders so as to extend in a front-back direction up to the opening of the mount holders on the front face of the engine holder.

* * * * *